US010877402B2

(12) United States Patent
Sabo et al.

(10) Patent No.: US 10,877,402 B2
(45) Date of Patent: Dec. 29, 2020

(54) PRINT AGENT APPLICATION ASSEMBLIES

(71) Applicant: HP Indigo B.V., Amstelveen (NL)

(72) Inventors: David Sabo, San Diego, CA (US); John W. Godden, San Diego, CA (US); Alex DeRegules, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/472,975

(22) PCT Filed: Feb. 27, 2017

(86) PCT No.: PCT/US2017/019742
§ 371 (c)(1),
(2) Date: Jun. 24, 2019

(87) PCT Pub. No.: WO2018/156169
PCT Pub. Date: Aug. 30, 2018

(65) Prior Publication Data
US 2020/0192248 A1 Jun. 18, 2020

(51) Int. Cl.
*G03G 15/10* (2006.01)
*G03G 15/16* (2006.01)
*G03G 15/20* (2006.01)

(52) U.S. Cl.
CPC ..... *G03G 15/104* (2013.01); *G03G 15/101* (2013.01); *G03G 15/1675* (2013.01); *G03G 15/2028* (2013.01); *G03G 2215/018* (2013.01)

(58) Field of Classification Search
CPC ..... G03G 15/104; G03G 15/101
See application file for complete search history.

(56) References Cited

U.S. PATENT DOCUMENTS 4,082,447 A 4/1978 Pascuzzi
5,329,850 A 7/1994 Durate
(Continued)

FOREIGN PATENT DOCUMENTS

GB 934921 8/1963
WO WO-0132432 5/2001

OTHER PUBLICATIONS

Boutet, J.C., Spring-Loaded Wiper-Blade Squeegees, Oct. 24, 2015, < http://ieeexplore.ieee.org/document/7233232/?reload=true &arnumber=7233232 >.

*Primary Examiner* — Sandra Brase
(74) *Attorney, Agent, or Firm* — Michael A Dryja

(57) ABSTRACT

In an example, a print agent application assembly includes a print agent transfer roller to receive print agent and transfer a portion of the print agent to a photoconductive surface and a print agent regulator roller to regulate a film thickness of print agent on the print agent transfer roller. The print agent regulator roller may include a nip forming region and a first mounting region. The print agent application assembly may further include a first resilient component which spans a diametrical width of the print agent regulator roller and acts on the print agent regulator roller outside the nip forming region to impart a lateral force to the first mounting region, the lateral force urging the print agent regulator roller towards the print agent transfer roller.

15 Claims, 4 Drawing Sheets

(56) References Cited

U.S. PATENT DOCUMENTS

| | | | | |
|---|---|---|---|---|
| 5,436,706 | A * | 7/1995 | Landa | G03G 15/101 399/168 |
| 5,610,694 | A * | 3/1997 | Lior | G03G 15/10 399/240 |
| 5,737,666 | A | 4/1998 | Lior et al. | |
| 5,739,900 | A | 4/1998 | Isobe | |
| 5,991,581 | A | 11/1999 | Kwak et al. | |
| 6,108,513 | A | 8/2000 | Landa et al. | |
| 6,453,809 | B2 | 9/2002 | Kempen | |
| 6,763,213 | B2 | 7/2004 | Ahn | |
| 6,999,701 | B2 | 2/2006 | Yoshino et al. | |
| 9,141,036 | B2 | 9/2015 | Berg | |
| 2004/0009018 | A1 | 1/2004 | Ito et al. | |
| 2014/0253652 | A1 | 9/2014 | Ohba et al. | |
| 2015/0055984 | A1* | 2/2015 | Lior | G03G 9/132 399/237 |

* cited by examiner

PRINT AGENT APPLICATION ASSEMBLIES

BACKGROUND

Printing systems such as liquid electro photographic printers may include at least one print agent application assembly. Print agent application assemblies may form images on a photoconductive member using liquid toner, and the like.

BRIEF DESCRIPTION OF DRAWINGS

For a more complete understanding, reference is now made to the following description taken in conjunction with the accompanying drawings in which.

DETAILED DESCRIPTION

Printing systems such as liquid electro photographic (LEP) printers include print agent application assemblies, which may be known as binary ink developer (BID) assemblies. The print agent application assemblies may utilize liquid toner (hereinafter print agent) to form images.

In such apparatus, a roller, which may be referred to as a print agent transfer roller, or a developer roller, bearing a layer of print agent is urged against a photoconductive surface (for example, a photoconductive imaging plate, which may be wrapped to form the surface of a drum). The photoconductive surface carries a charge pattern, which provides a latent image corresponding to the image to be printed. Due to the relative charges of the print agent, the photoconductive surface and the print agent transfer roller, print agent is transferred from the print agent transfer roller to the photoconductive surface to form the image to be printed. In order to regulate the thickness of the layer of ink on the print agent transfer roller, a print agent regulator roller, which may be referred to as a "squeegee" roller, may be urged against the print agent transfer roller to control the thickness of an ink layer which is transferred to the photoconductive surface.

Figure 1:
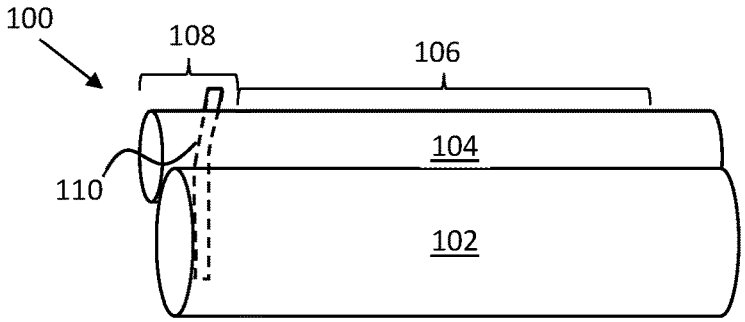
FIG. 1 shows an example of a print agent application assembly.

FIG. 1 shows an example of a print agent application assembly 100 comprising a print agent transfer roller 102 and a print agent regulator roller 104. The print agent transfer roller 102 receives print agent and transfer at least a portion of the print agent to a photoconductive surface. The print agent regulator roller 104 regulates a film thickness of print agent on the print agent transfer roller 102. The print agent regulator roller 104 comprises a nip forming region 106 and a first mounting region 108. The 'nip' is formed between the print agent transfer roller 102 and print agent regulator roller 104 and represents the portion of the rollers 102, 104 which may exchange print agent, or between which a film of print agent is compressed. The mounting region 108 extends beyond the nip-forming region 106 and may comprise any mounting, for example an axle to be received in rotational support such as a bearing or the like. In some examples, the resilient component 110 may act on the mounting region 108 directly. In some examples, the resilient component 110 may act on the mounting region 108 via a print agent regulator roller mounting, such as a bearing or the like. Although in this example, the print agent transfer roller 102 and print agent regulator roller 104 are the same length, in another example, the print agent transfer roller 102 may be approximately the length of the nip forming region 106.

The print agent application assembly 100 further comprises a first resilient component 110. The first resilient component 110 spans a diametrical width of the print agent regulator roller 104 and acts on the print agent regulator roller 104 outside the nip forming region 106 to impart a lateral force to the mounting region 108 (which may be lateral to the longitudinal axis of the print agent regulator roller 104), the lateral force urging the print agent regulator roller 104 towards the print agent transfer roller 102.

By providing a lateral force to the mounting region 108, rather than the nip forming region 106, there is no interference between the first resilient component 110 and any print agent which is transferred to the print agent regulator roller 104 from the print agent transfer roller 102 is prevented. Moreover, the use of a resilient component 110 which spans the diametrical width of the print agent regulator roller 104 means that force may be applied using an elongate resilient component. As is further set out below, such a resilient component 110 may be relatively simple, for example comprising a sheet metal member (e.g. a leaf spring), and may extend to a mounting point which is spaced from the rollers 102, 104. As the geometry of a print apparatus and/or its components may mean that space may be relatively constrained near the rollers 102, 104, this allows the resilient component 110 to extend to a region in which such constraints may be lessened. In some examples, the resilient member 110 may curve around at least a portion of the circumference of the mounting region 108 (or curve around a print agent regulator roller mounting, for example a rotational support such as a bearing or the like, in which the mounting region 108 is received), or otherwise be deflected from a rest position and/or shape by the mounting region 108 and/or receiving portion, which allows it apply force to the mounting region 108 while having a compact form.

Figure 2A:
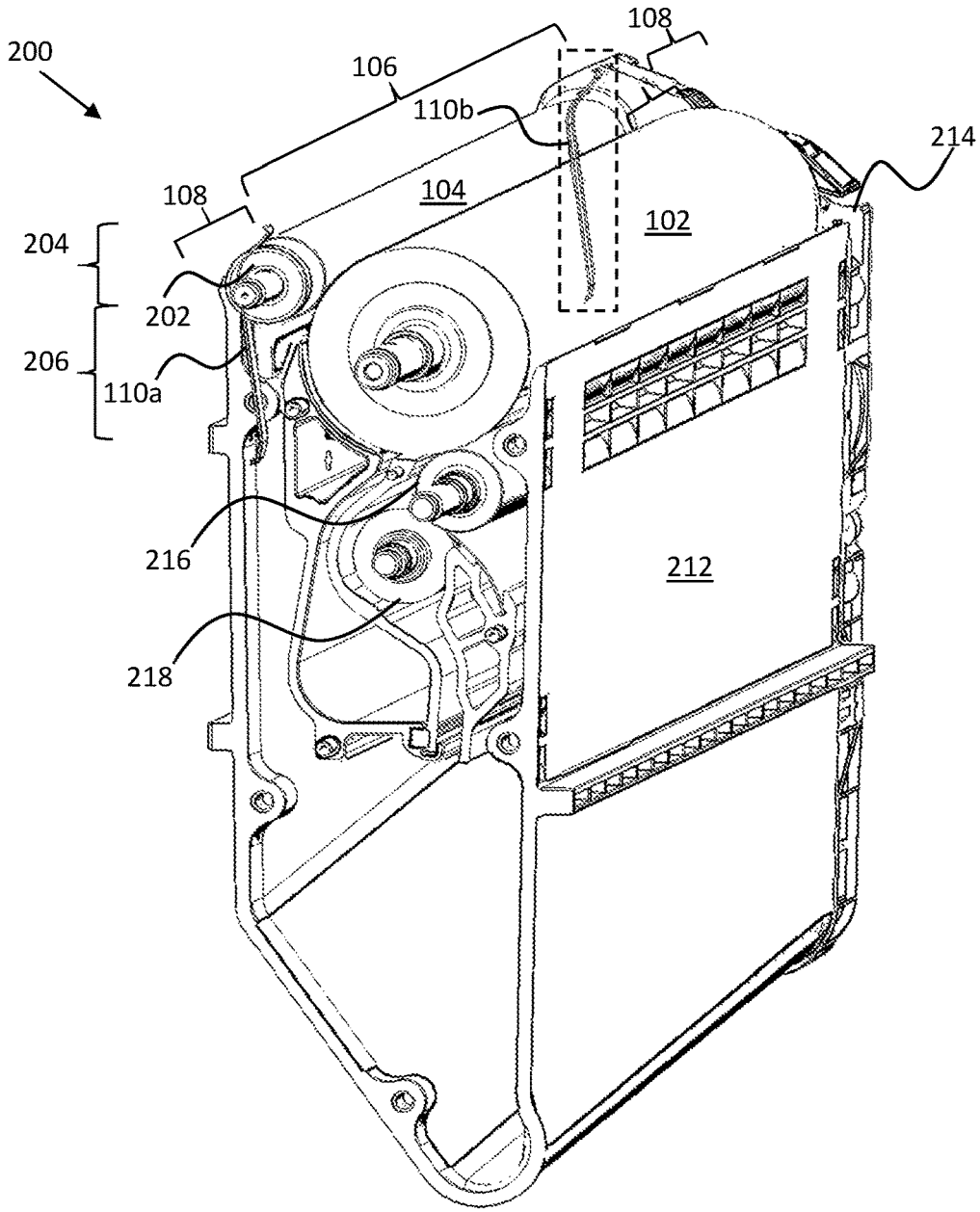
FIGS. 2A and 2B show another example of a print agent application assembly.
Figure 2B:
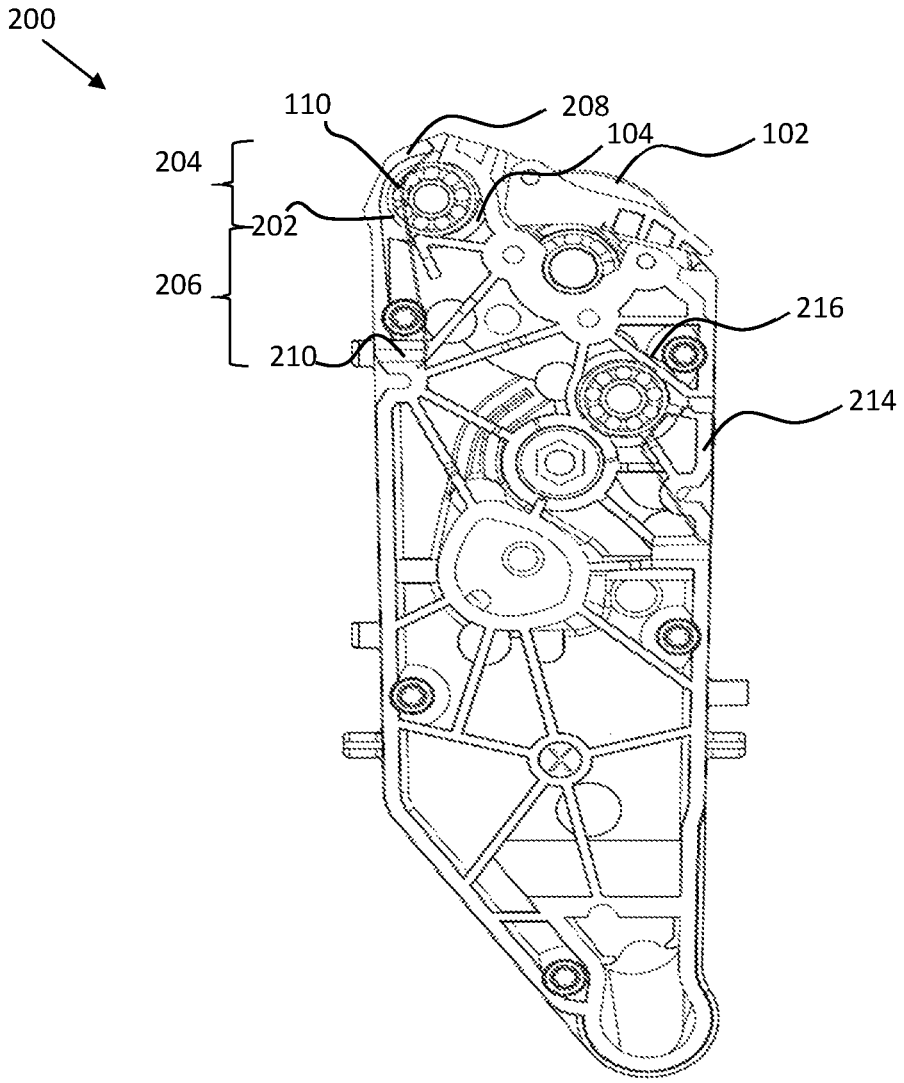

FIGS. 2A and 2B respectively show a perspective and cross section of another example of a print agent application assembly 200, in which components in common with FIG. 1 are labelled with like numbers.

In the perspective view of FIG. 2A, one of two end plates 214 (shown in greater detail in FIG. 2B) has been removed from one side to expose the interior of print agent application assembly 200.

As can be seen from FIG. 2A, in this example, there are first and second mounting regions 108, one at either end of the print agent regulator roller 104 and first and second resilient components 110*a*, 110*b*, which respectively act on the mounting regions and each of which comprises a sheet metal spring, i.e. a 'leaf spring'. The second resilient component 110*b*, which would be obscured by the other components in the view presented, is shown in a dashed box to indicate its position. The first and second mounting regions 1 are axially separated from one another, in this example being separated by the nip forming region 106 of the print agent regulator roller 104.

Providing a force at each end of the print agent regulator roller 104 may allow a nip pressure to be exerted along the length of the print agent regulator roller 104. The mounting regions 108 of the print agent regulator roller 104 in this example are provided by a central axle, which is of a smaller diameter than the diameter of the nip forming region 106. The axle is received at each end by a print agent regulator roller mounting, which in this example is a rotational support, in this example bearing 202 (one of which is shown in cut-through view in FIG. 2B, and just one of which is visible in FIG. 2A) and the resilient components 110 are positioned so as to act on the outer race of the bearings 202. It may be noted that, if the resilient components 110 were to act directly on a mounting region 108, there would be relatively high rotational friction and possible heat generation. Having the resilient components 110 act on the outer race of the bearings 202 applies the force to the mounting regions 108 of the print agent regulator roller 104 while allowing relatively low rotational friction via the bearings 202. In this example, the print agent regulator roller 104 and/or the bearings 202 may be mounted so as to be somewhat moveable in their mountings.

Leaf springs are compact, which means that they can be inserted into the space around the bearings 202 and act directly thereon. In addition, as leaf springs are mechanically simple components, they are robust once installed.

The resilient components 110 in this example each comprise a first section 204 which spans the width of the print agent regulator roller 104 and a second section 206 which extends into a region of the print agent application assembly 200 outside a region containing the print agent regulator roller 104. As mentioned above, there may be fewer space constraints in such a region. The second section 206 has a length which is greater than a length of the first section 204. This may allow for ease of deformation of the resilient components 110 during manufacture of the print agent application assembly 200 as acting on an end of the resilient component 110 which is relatively distant from the mounting region 108 around which the resilient component 110 may be deformed provides a mechanical advantage. In this example, it may be noted that each of the ends of the resilient components 110 comprise a securing feature in the form of a fold-back portion. This may assist in arranged and securing the resilient components 110 in position. In other examples, resilient components 110 may lack such a securing feature, or comprise an alternative securing feature, such as a cut-out or lateral projection or the like.

The print agent application assembly 200 further comprises a housing 212 (which is shown in an incomplete form in FIG. 2A to expose the interior of the print agent application assembly 200, lacking an end plate and an upper portion). As is shown in FIG. 2B, the housing 212 comprises retaining features 208, 210, in this example in the form of retaining lugs, for retaining a first and a second end of each of the first and second resilient components 110. The print agent regulator roller 104 is positioned between the retaining features 208, 210 for each resilient component 110*a, b*. Providing retaining features 208, 210 integrally with the housing 212 provides for simple manufacturing techniques. The housing 212 may for example be formed of at least one injection molded component, for example being formed of a thermosetting, or hard, plastic. The retaining features 208, 210 may be integrally formed at the point of molding.

In this example, the retaining features 208, 210 are formed in end plates 214 of the housing 212, the print agent regulator roller 104 being mounted such that the nip forming region 106 is between the end plates 214 and each mounting region 108 is separated from the nip forming region 106 by the end plates 214. The end plates 214 may also serve to reduce print agent transfer to the mounting regions 108. The retaining features 208, 210 in this example comprise projections from the face of the end plates 214, although in other examples, the retaining features 208 may comprise recesses in the end plates 214 to receive a portion of the resilient components 110, or a combination or recesses and projections, or be formed in some other way. In some examples, retaining features may be provided on a component other than the housing.

In particular, in this example, retaining features 208, 210 comprise wall-like projections from the face of the end plates 214, and the fold-back securing features of the resilient components may be formed to engage with the ends of the projections. The retaining features 208, 210 may be formed to provide 'hook' like features which retain an end of a resilient component 110 in at least one dimension, and/or may be designed to cooperate with at least one securing feature of the resilient components 110. In some examples, the retaining features 208, 210 (in some examples, in cooperation with any securing features of the resilient components 110) may restrain the ends of the resilient components 110 from movement in a first direction, which may be substantially within the plane of the page/end plate 214 as shown in FIG. 2B. In some examples, the retaining features 208, 210 (in some examples, in cooperation with any securing features of the resilient components 110) may restrain the ends of the resilient components 110 from movement in a second direction and the second direction may be substantially perpendicular to the page as shown in FIG. 2B, for example being a direction which is away from the external face of an end plate 214. The end plates 214 themselves, for example a face thereof, may restrain movement of the end of the resilient components 110 in another direction, which may also be substantially perpendicular to the page as shown in FIG. 2B. Such arrangements may assist in securing a resilient component 100, which may for example be subject to vibration and the like, without requiring fixings, adhesives or the like. The resilience of the resilient component 110 and/or the form of a securing feature may secure the resilient components 110 from movement at least one direction, which may be different to the direction of restraint provided by the retaining features 208, 210 and/or by the end plates 214.

Arranging the resilient components 110 (and/or providing retaining features 208, 210) on the exterior of the housing 212 means that the resilient components 110 may be added after the interior components of the print agent application assembly 200 have been assembled within the housing 212. Adding a resilient component 110 for example having the form of a leaf spring at this point is a relatively simple process, as the rollers 102, 104 may be mounted within the housing 212 without working against a biasing force, and then the biasing force is applied to securely mounted roller 104.

The resilient components 110 may be deflected from a rest position by being formed around the bearings 202 while engaged with one or both retaining features 208, 210. In some examples, the resilient components 110 may follow the form of the mounting regions 108, or a mounting component in which the mounting regions 108 are mounted, of the print agent regulator roller 104, thus occupying little volume beyond that of the print agent regulator roller 104 itself. In one example, a resilient component 110 may be deflected from a rest position by being formed around the bearings 202 while engaged at a first end with a first retaining feature 208, 210, which holds it in place while the deformation occurs, before being engaged with the second retaining feature 208, 210, which secures it in a deflected position so as to impart a lateral force to a bearing 202.

In this example, the print agent transfer roller 102 comprises an aluminium core coated in a rubber-like (e.g. polyurethane) coating of around 4 mm thickness, with a diameter of around 40 mm and a length of around 330 mm. The print agent regulator roller 104 may for example comprise a steel roller which may be coated to reduce corrosion, for example with an electroless nickel plating. The print agent regulator roller 104 may have a diameter of around 16 mm and a length of around 330 mm. Each resilient component 110*a*, 110*b* is around 45 mm in length and exerts a force of around 30 Newton. The resilient component 110 in this example comprises spring steel, which provides high yield stress and is unlikely to exhibit plastic deformation during assembly or operation. In an example, a spring steel comprises a pre-tempered stainless steel 17-7 Condition C which is heat treated to condition CH 900 for higher hardness and yield stress. However, this is purely by way of example, and other dimensions or materials may be seen in other examples.

In some examples, the print agent regulator roller 104 may be of a length and stiffness such that any flexibility along its length is relatively minimal so as to allow for a relatively consistent pressure along the nip. In other examples, the print agent regulator roller 104 may be formed or 'crowned' with a profile (for example a parabolic profile) so that it is larger in diameter at the centre than at the ends so as to compensate for any flex and provide a more consistent nip pressure along the length than if such a profile was lacking.

As is shown in FIG. 2B, the end plates 214 may comprise cut out portions and/or strengthening ribs. As is best shown from FIG. 2A, the print agent application assembly 200 may comprise a print agent transfer roller cleaning assembly. In this example this comprises a cleaner roller 216 and a sponge roller 218. The cleaner roller 216 rotates to clean the print agent transfer roller 102. The sponge roller 218 cleans the cleaner roller 216. In other examples, the cleaning assembly may comprise additional or alternative components. The print agent application assembly 200 may comprise additional components, for example electrodes and the like, which are not described in detail herein.

Figure 3:
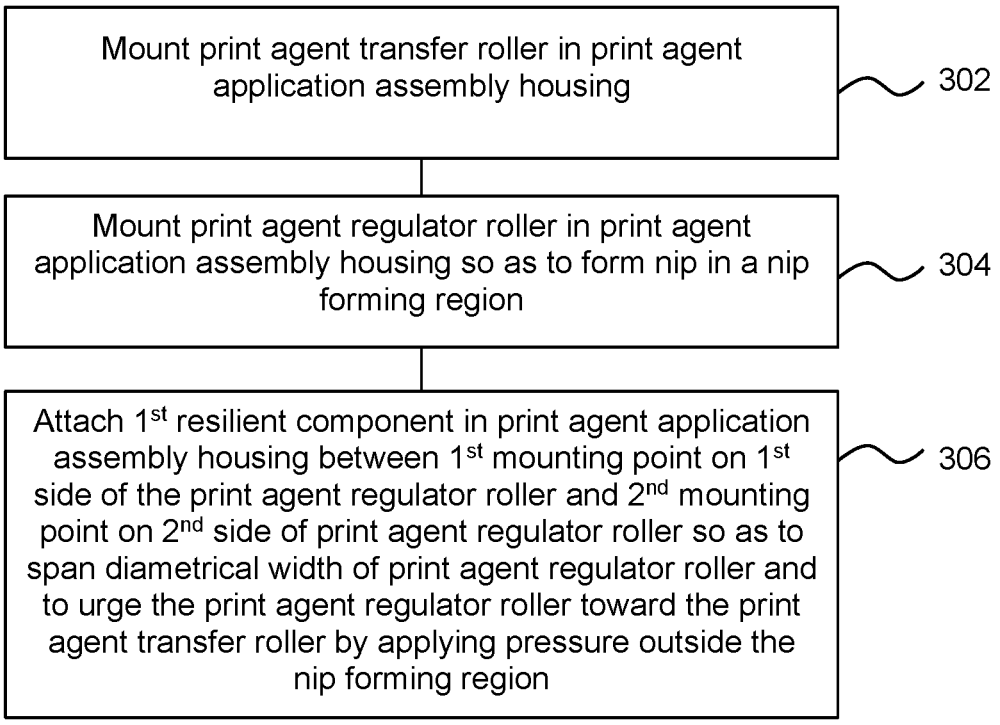
FIG. 3 is a flowchart of an example method of forming a print agent application assembly.

FIG. 3 is an example of a method, which may be a method of manufacturing a print agent application assembly. The method comprises, in block 302, mounting a print agent transfer roller in a print agent application assembly housing. Block 304 comprises mounting a print agent regulator roller in the print agent application assembly housing so as to form a nip in a nip forming region thereof. The nip may be formed between the print agent regulator roller and the print agent transfer roller. Block 306 comprises attaching a first resilient component to the print agent application assembly housing between a first mounting point on a first side of the print agent regulator roller and a second mounting point on a second side of the print agent regulator roller so as to span the diametrical width of the print agent regulator roller and to urge the print agent regulator roller toward the print agent transfer roller by applying pressure thereto outside the nip forming region.

In some examples, the print agent transfer roller and the print agent regulator roller may be mounted within a housing, and the first resilient component may be attached to the exterior of the housing. In some examples, attaching the first resilient component may comprise causing the first resilient component to interact with retaining features provided on the housing. In some examples, attaching the first resilient component so as to apply pressure thereto outside the nip forming region comprises applying pressure to the outside of a cylindrical bearing's outer race, and mounting the print agent regulator roller comprises mounting the print agent regulator roller within the cylindrical bearing. In some examples, the method may further comprise mounting the print agent application assembly in a print apparatus (in which case the method may comprise a method of assembling a print apparatus).

Figure 4:
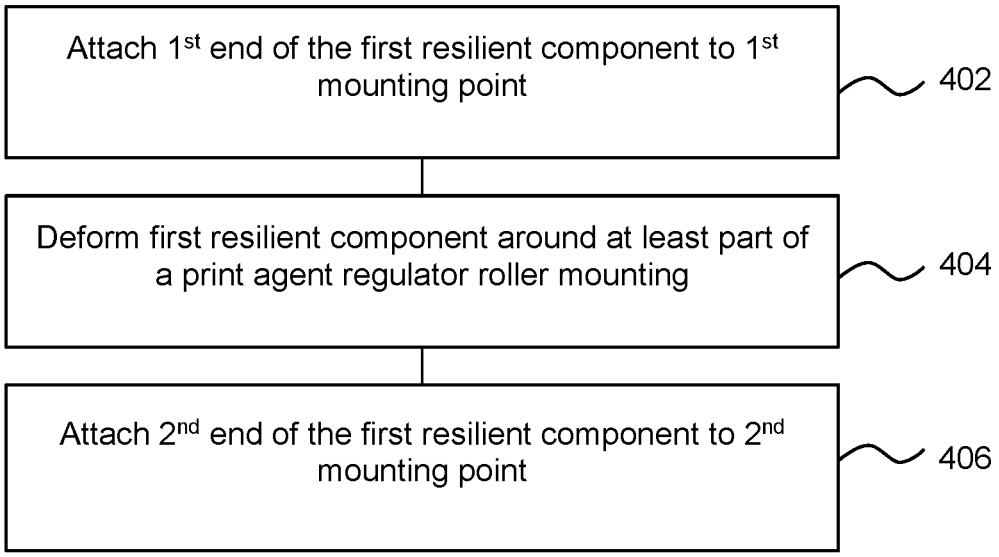
FIG. 4 is a flowchart of an example method of placing a resilient member in a print agent application assembly.

FIG. 4 is an example of the method of performing block 306 of FIG. 3. The method comprises, in block 402, attaching a first end of the first resilient component to a first mounting point. Block 404 comprises deforming the first resilient component around at least part of a print agent regulator roller mounting, which may for example be the mounting portion or may be a receiving element in which the mounting portion is mounted such as a bearing or the like. Block 406 comprises attaching a second end of the first resilient component to a second mounting point, wherein the first mounting point is closer to an axis (e.g. the longitudinal axis of the roller) of the print agent regulator roller than the second mounting point. The mounting points may have any of the features of the retaining features described in relation to FIG. 2A and FIG. 2B above.

By attaching the first end to the first mounting point which is closer to an axis of the print agent regulator roller than the second mounting point, the method may benefit from the mechanical advantage is provided when attaching the second end to the more distant second mounting point.

Block 306 and/or the blocks of FIG. 4 may also be carried out in relation to a second resilient component, which may be attached to the housing between a third mounting point on the first side of the print agent regulator roller and a fourth mounting point on the second side of the print agent regulator roller so as to span the diametrical width of the print agent regulator roller and to urge the print agent regulator roller toward the print agent transfer roller, such that the first resilient component acts on a first lateral portion of the print agent regulator roller and the second resilient component acts on a second lateral portion of the print agent regulator roller; wherein the first lateral portion and the second lateral portion are laterally spaced from one another. For example, they may be at either end of the print agent regulator roller, and/or may be either side of the nip forming region.

In some examples, the method of FIG. 3 and/or FIG. 4 may be a method of manufacturing a print agent application assembly as described in relation to FIG. 1 or FIG. 2 above.

Figure 5:
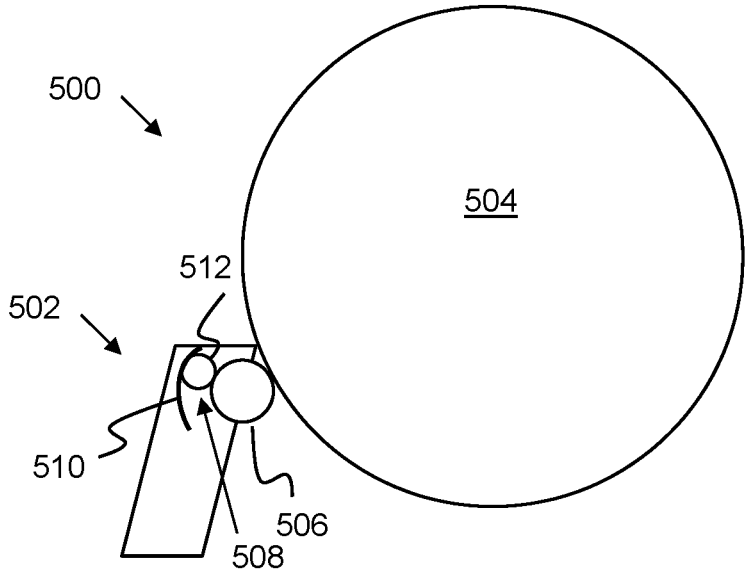
FIG. 5 shows an example of a print apparatus.

FIG. 5 shows an example of a print apparatus 500 comprising a print agent application assembly 502 and a photoconductive surface 504. The print agent application assembly 502 is to transfer a layer of print agent to the photoconductive surface 504, and the thickness of the layer of print agent is controlled by a nip pressure formed between rollers 506, 508 in the print agent application assembly 502, the pressure being controlled by a first and second sheet metal spring 510 (just one of which is visible in FIG. 5) acting on a respective first and second roller mounting 512 (just one of which is visible in FIG. 5) to provide the nip pressure. The first and second roller mountings 512 may for example be a mounting portion of a roller or may be a receiving element in which the mounting portion is mounted such as a rotational support such as a bearing or the like. For example, the print agent application assembly 502 may be a print agent application assembly as described in relation to FIG. 1 or FIG. 2 above.

Such a print apparatus 500 may comprise additional components, for example media or image transfer apparatus, additional print agent application assembly 502, heaters and the like. In some examples the print apparatus 500 is an LEP.

While the method, apparatus and related aspects have been described with reference to certain examples, various modifications, changes, omissions, and substitutions can be made without departing from the spirit of the present disclosure. It is intended, therefore, that the method, apparatus and related aspects be limited by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent application assembly comprising:

a print agent transfer roller to receive print agent and transfer a portion of the print agent to a photoconductive surface;

a print agent regulator roller to regulate a film thickness of print agent on the print agent transfer roller, the print agent regulator roller comprising a nip forming region and a first mounting region including an axle region at which an axle of the print agent regulator roller is exposed; and a first resilient component, which spans a diametrical width of the print agent regulator roller and acts on the print agent regulator roller outside the nip forming region and outside the axle region of the first mounting region to impart a lateral force to the first mounting region outside the axle region, the lateral force urging the print agent regulator roller towards the print agent transfer roller.

2. The print agent application assembly according to claim 1 in which the first resilient component comprises a sheet metal spring.

3. The A print agent application assembly according to claim 1 in which the first resilient component comprises a first section which spans the diametrical width of the print agent regulator roller and a second section which extends into a region of the print agent application assembly outside a region containing print agent regulator roller.

4. The print agent application assembly according to claim 3 in which the second section has a length which is greater than a length of the first section.

5. The print agent application assembly according to claim 1 further comprising a housing, the housing comprising retaining features for retaining a first end and a second end of the first resilient component.

6. The print agent application assembly according to claim 5 in which the housing comprises end plates and the print agent regulator roller is mounted such that the nip forming region is between the end plates and each mounting region is separated from the nip forming region by the end plates, wherein the retaining features are formed on the end plates.

7. The print agent application assembly according to claim 1 further comprising a housing, wherein the nip forming region of the print agent regulator roller is provided inside the housing and the first resilient component and at least part of the first mounting region are provided outside the housing.

8. The print agent application assembly according to claim 1 wherein the print agent regulator roller comprises a second mounting region which is axially separated from the first mounting region, the print agent application assembly further comprising a second resilient component, the second resilient component acting on the second mounting region.

9. The print agent application assembly according to claim 1 further comprising a rotational support, wherein the first mounting portion of the print agent regulator roller is mounted within a rotational support and the first resilient component is positioned so as to act on the exterior of the rotational support.

10. The print agent application assembly according to claim 1 wherein the lateral force is approximately 30 Newton.

11. A method comprising:

mounting a print agent transfer roller in a print agent application assembly housing;

mounting a print agent regulator roller in the print agent application assembly housing so as to form a nip in a nip forming region thereof interior to a first mounting region including an axle region at which an axle of the print agent regulator roller is exposed; and attaching a first resilient component to the print agent application assembly housing between a first mounting point on a first side of the print agent regulator roller and a second mounting point on a second side of the print agent regulator roller so as to span a diametrical width of the print agent regulator roller and to urge the print agent regulator roller toward the print agent transfer roller by applying pressure thereto outside the nip forming region and outside the axle region of the first mounting region.

12. The method according to claim 11, wherein mounting the first resilient component comprises deforming the first resilient component around at least part of a print agent regulator roller mounting.

13. The method according to claim 12, wherein mounting the first resilient component comprises mounting the first resilient component between the first mounting point and the second mounting point, wherein the first mounting point is closer to an axis of the print agent regulator roller than the second mounting point.

14. The method according to claim 11 further comprising attaching a second resilient component between a third mounting point on the first side of the print agent regulator roller and a fourth mounting point on the second side of the print agent regulator roller so as to span the diametrical width of the print agent regulator roller and to urge the print agent regulator roller toward the print agent transfer roller, such that the first resilient component acts on a first lateral portion of the print agent regulator roller and the second resilient component acts on a second lateral portion of the print agent regulator roller; wherein the first lateral portion and the second lateral portion are laterally separated from one another by the nip forming region.

15. A print apparatus comprising:

a photoconductive surface; and a print agent application assembly to transfer a layer of print agent to the photoconductive surface, the print agent application assembly having a nip region between rollers in the print agent application assembly across which a thickness of the layer of print agent is controlled by a nip pressure between the rollers, the nip pressure controlled by a first and second sheet metal spring acting between the nip region and axle regions of the print agent application assembly outside the nip region and at which axles of the print agent application assembly are exposed, to provide the nip pressure.

* * * * *